US005279535A

United States Patent [19]

Hawes et al.

[11] Patent Number: 5,279,535

[45] Date of Patent: Jan. 18, 1994

[54] INTERNALLY COOLED ROLLER

[75] Inventors: George A. Hawes, Worksop; Jeffery Williams, Sheffield, both of England

[73] Assignee: British Steel PLC, London, England

[21] Appl. No.: 972,646

[22] Filed: Nov. 6, 1992

[30] Foreign Application Priority Data

Nov. 7, 1991 [GB] United Kingdom ..... 9123666.1

[51] Int. Cl.[5] ..... B21B 31/08

[52] U.S. Cl. ..... 492/46; 165/90; 492/47

[58] Field of Search ..... 492/46, 47; 165/89, 165/90

[56] References Cited

U.S. PATENT DOCUMENTS

| | | | |
|---|---|---|---|
| 1,781,378 | 11/1930 | Feeney | 492/46 X |
| 3,548,929 | 12/1970 | Gross | 165/89 |
| 3,738,423 | 6/1973 | Fleissner | 165/89 |
| 3,838,734 | 10/1974 | Kilmartin | 165/90 |
| 4,050,510 | 9/1977 | Theysohn | 165/89 |
| 4,086,957 | 5/1978 | Schrewe et al. | 492/46 X |
| 4,506,727 | 3/1985 | Swasey | 165/90 |
| 5,072,497 | 12/1991 | Zaoralek et al. | 492/46 |

FOREIGN PATENT DOCUMENTS

| | | | |
|---|---|---|---|
| 1132323 | 6/1962 | Fed. Rep. of Germany | 165/89 |
| 1947768 | 6/1971 | Fed. Rep. of Germany | 165/89 |

*Primary Examiner*—Timothy V. Eley
*Attorney, Agent, or Firm*—Bacon & Thomas

[57] ABSTRACT

An internally cooled cylindrical roller for use in continuously casting strands of partially or wholly solidified metal is formed with a plurality of longitudinally extending coolant-conveying bores which extend over the entire length of the roller. An annular manifold in the form of an end cap is secured within a recess formed in each end face of the roller and includes a plurality of discrete pathways each of which places the open ends of two longitudinally extending bores in communication one with another and at least one additional pathway positioned to place the open end of one bore in communication with a coolant inlet or coolant outlet passageway of the roller.

7 Claims, 4 Drawing Sheets

INTERNALLY COOLED ROLLER

BACKGROUND OF THE INVENTION

1. Field of the Invention

This invention relates to cooling of rollers. More especially, but not exclusively, the invention concerns the cooling of rollers used for transporting a continuously cast strand of partially and wholly solidified metal from an open-ended mould positioned to receive molten metal from a tundish.

2. Discussion of the Prior Art

One of the developments that has taken place in steel making over the past years has been continuous casting of liquid steel. In this process liquid steel is poured continuously from a tundish into an open-ended mould and is continuously extracted therefrom as a partially solidified strand by a train of rollers. The process is such that the outer skin of the steel solidifies sufficiently within the confines of the mould to enable the continuous strand of cast steel to be extracted therefrom and transported by the rollers along a curved downwardly inclined path while containing, at least initially, still liquid metal in the inside of the strand.

It will be appreciated that this process imposes considerable heat stresses upon the rollers which are at any given time in contact with the steel strand and where the rollers are internally cooled, usually by water circulating within them, considerable attention has to be paid to the cooling process to avoid asymmetric heating during thermal cycling of the rollers during both normal and abnormal casting conditions. The usual arrangement of water cooling within such a roller is through bores which extend between the roller ends with the axis of each bore set at the same distance from the roller surface. The number of bores provided is usually as high as possible and the bores are conventionally positioned as near to the surface of the roller as possible while retaining the necessary strength to sustain geometric stability and minimise bending of the roller during both normal and abnormal casting conditions.

A disadvantage which arises with such known rollers occurs at the roller ends where the flow of liquid passing towards one roller end through one peripheral bore must be returned along another peripheral bore to the opposite end of the roller; also, inlets and outlets must be provided to admit liquid to and to remove liquid from the roller. This problem is complicated by the fact that the roller is conventionally produced from a solid piece of machined metal, through which it is only possible to drill straight bores. This has meant that the flow of fluid through the bores does not continue to the bore ends but is diverted along angled bores remote from the bore ends to provide zig zag connecting paths between the communicating peripheral bores. It will be appreciated that such an arrangement means that the ends of the roller are not cooled to the same extent as the remaining length of the roller; consequently, particularly severe overheating during plant stoppage or thermal cycling can take place especially with centre bearing rollers. Also, the multiplicity of angled bores required places a limit on the number of peripheral bores which can be present without adversely affecting the geometric stability of the rollers during normal and abnormal casting conditions.

Because of the need to machine into a conventional internally cooled roller a multiplicity of angled bores, the production costs of such rollers is high. Rollers in accordance with the present invention, however, can be produced relatively cheaply because inter alia the number of angled bores is significantly reduced.

SUMMARY OF THE INVENTION

It is an object of the present invention to provide an internally cooled roller which does not suffer from, or at least alleviates, the disadvantages referred to above.

According to the present invention there is provided an internally cooled cylindrical roller provided with a plurality of bores which extend over the entire length of the roller and through which cooling liquid can circulate and a manifold attached to each end of the roller and including a plurality of discrete pathways each positioned to place open ends of two bores in communication one with the other, and at least one additional pathway positioned to place an open end of one bore in communication with an inlet passageway for conveying cooling liquid to the roller.

The pathways may be positioned to place neighboring bores in communication with one another.

BRIEF DESCRIPTION OF THE DRAWINGS

The invention will now be described by way of example only with reference to the accompanying diagrammatic drawings, in which.

DETAILED DESCRIPTION OF THE INVENTION

Figure 1:
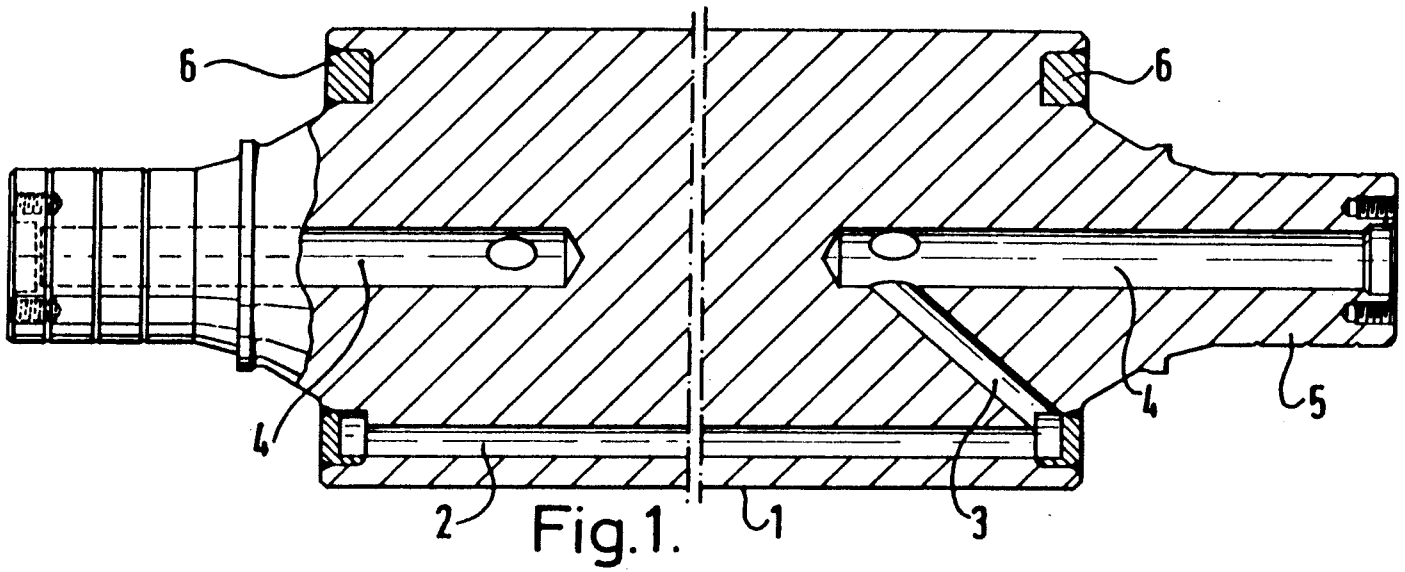
FIG. 1 is a side view in section of an internally cooled roller and manifold assembly in accordance with the invention.
Figure 2:
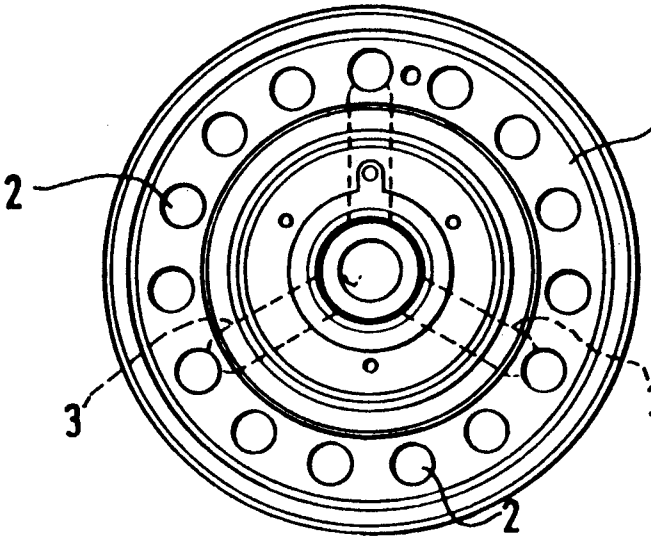
FIG. 2 is an end view of the roller illustrated in FIG. 1 before fitting of the manifold.

The roller illustrated in FIGS. 1 and 2 has a cylindrical body 1 which includes a plurality of peripheral bores 2 which extend along the full length of the roller body between the ends thereof. As will be seen more clearly from FIG. 2, three of the lengthwise extending bores 2 communicate with inclined bores 3 (shown in broken line in FIG. 2) which, in turn, communicate with central passageways 4 of the roller body and its journals 5, the passageways 4 being connected to pass coolant fluid (e.g. water) to and from the roller 1. As illustrated, the roller includes fifteen lengthwise extending peripheral bores 2 and three inclined bores 3. It will, of course, be understood that more or less such bores 2,3 could be provided depending upon the required coolant flow and the diameter and structure of the roll. Secured to each end face of the roller 1 is an annular manifold in the form of an end cap 6 which serves the purpose of enabling coolant flowing through one bore 2 of the roller body to return along the length of the roller through another such bore 2. Each end cap 6 is of substantially the same construction and one is illustrated in greater detail in FIGS. 3 and 4.

Figure 3:
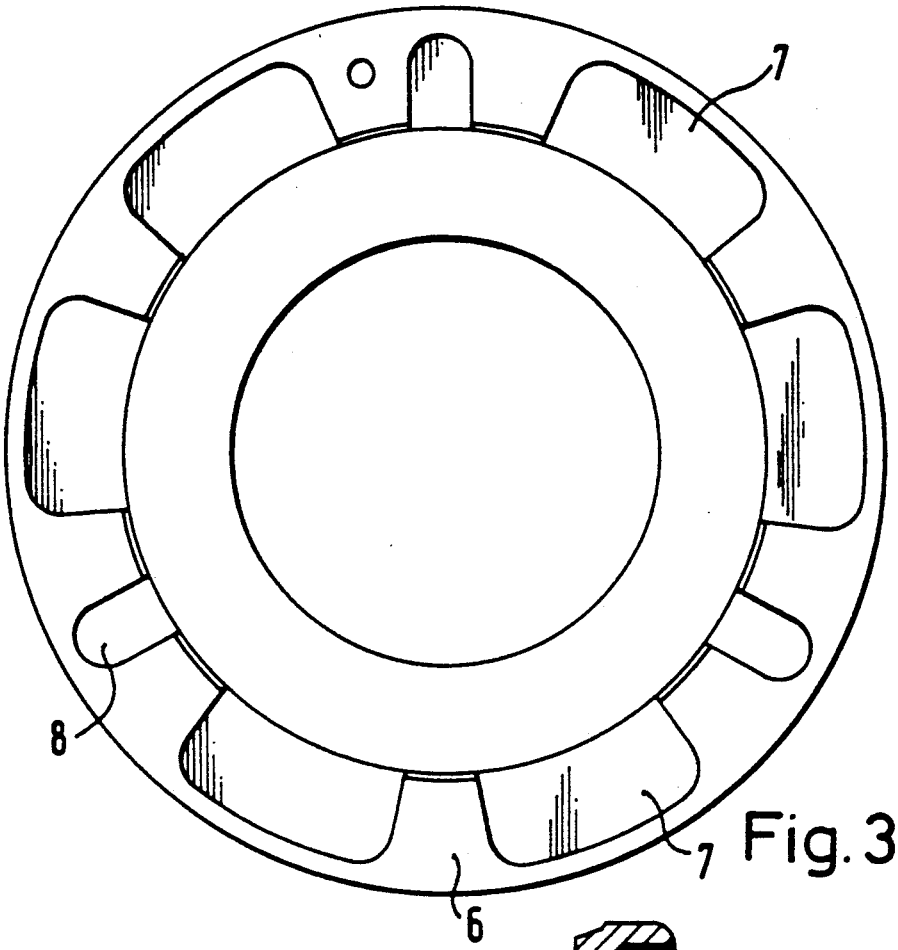
FIG. 3 is an end view of a manifold in the form of an end cap of the roller illustrated in FIG. 1.

As will be seen from FIG. 3, the end cap 6 is formed (preferably by machining) with six recesses 7 each of a width sufficient to embrace two adjoining bores 2 and each of a depth to enable coolant to flow from one such bore in a first direction and to return through the adjoining bore in a reverse direction. The internal shape of each machined recess is such as to assist in encouraging the required reversal in flow direction. The end cap 6 also includes three additional recesses 8 each of a width sufficient to embrace only one bore 2 and each of a depth to enable coolant to flow to or from that bore 2 and to leave or enter, as the case may be, one of the inclined bores 3. The end caps may be secured to the roller by any conventional means, for example by welding.

Figure 4:
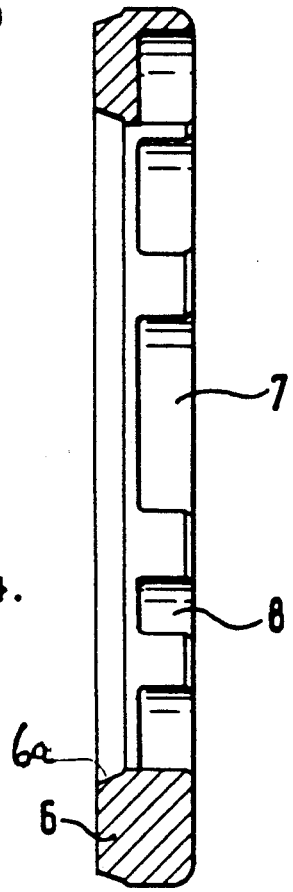
FIG. 4 is a side view in section of the manifold illustrated in FIG. 3.

As will be seen from FIG. 4, the radially inner internal edge of each end cap 6 is radiused at 6a to enable air trapped within the bores 2 to vent to atmosphere.

Each end cap 6 is of annular configuration to ensure that the journals 5 of the roller 1 are free to engage readily within their bearing mountings.

In use, coolant fluid is transported from a source to one or more of the bores 3 of the roller. The coolant passes along the respective central passageway 4 and the respective inclined bore 3 to enter one of the bores 2 via one of the recesses 8. The coolant then flows sequentially through adjacent bores 2 and is directed from one bore to another by means of the recesses 7 until it leaves the roller through one recess 8 and the respective inclined bore 3 and central passageway 4. By this arrangement, the entire roller length is effectively cooled by the coolant.

Also, by removing the need for a multiplicity of angled bores (conventionally two for each peripheral bore), a significantly greater number of peripheral bores 2 can be provided without adversely affecting the geometric stability or resistance to bending of the roller during normal and abnormal casting conditions.

Figure 5:
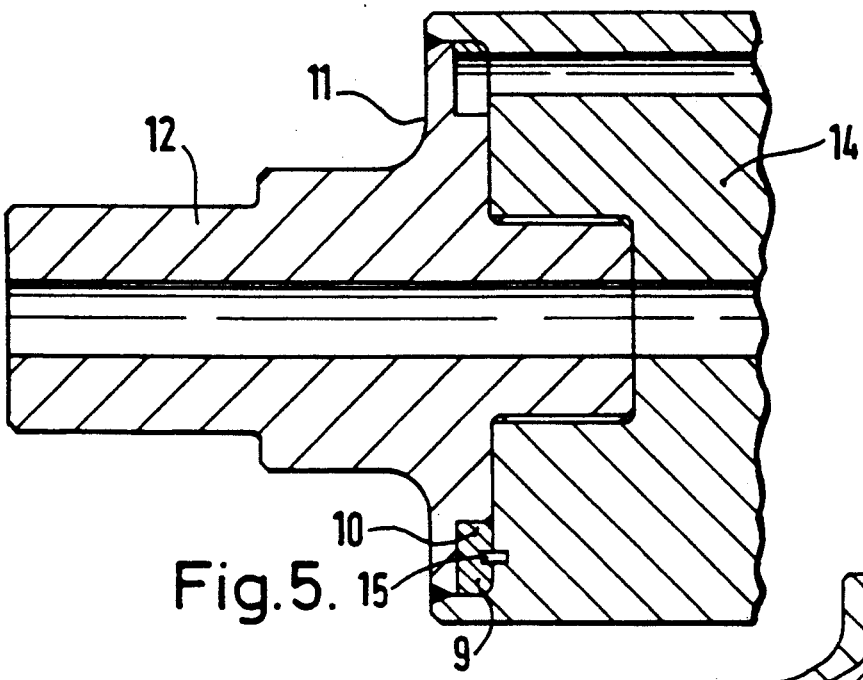
FIGS. 5 to 7 are side views in section of alternative roller and manifold assemblies in accordance with the invention.
Figure 6:
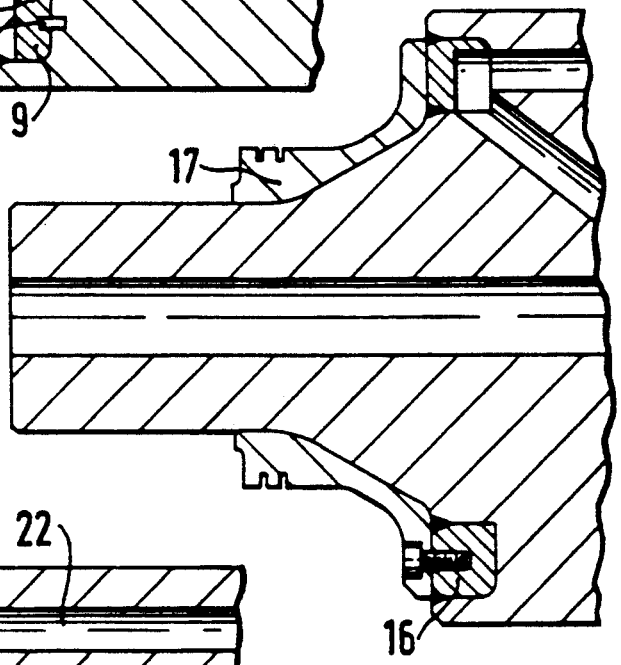
Figure 7:
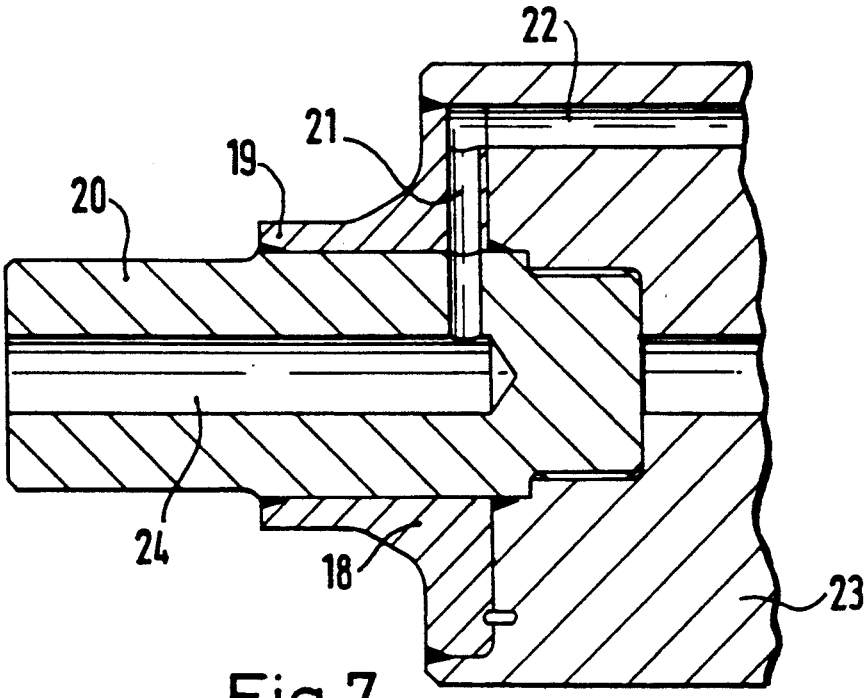

Turning now to FIGS. 5 to 7, it will be seen that these illustrate alternative roller and manifold assemblies in accordance with the invention. In each Figure only one manifold is illustrated. It will, however, be appreciated that one such manifold is secured to each roller end.

In FIG. 5, the annular manifold 9 illustrated locates within a step 10 formed in the inner face of an upstanding annular flange 11 of a journal insert 12 of a roller 14. The manifold is located with respect to the roller 14 by one or more pins 15 or the like. Internal containment of the annular manifold 9 allows the journal insert 12 to rotate on assembly. Each manifold is of similar construction to that illustrated in FIGS. 3 and 4.

In FIG. 6, an annular manifold 16 is employed additionally as a mounting for a separate member, for example a labyrinth/bearing shoulder ring 17 as illustrated.

In FIG. 7 an extended manifold 18 is provided. The manifold 18 includes a rearwardly extending neck section 19 which supports a journal insert 20 and provides a bearing shoulder. It will also be noted that the manifold 18 includes generally radial bores 21 for conveying coolant to and from peripheral bores 22 of a roller 23, such coolant passing from a source or to a reservoir through passageways 24 formed in the journal insert 20. In this arrangement, the need for the inclined bores 3 of FIGS. 1 and 2 is removed.

Figure 8:
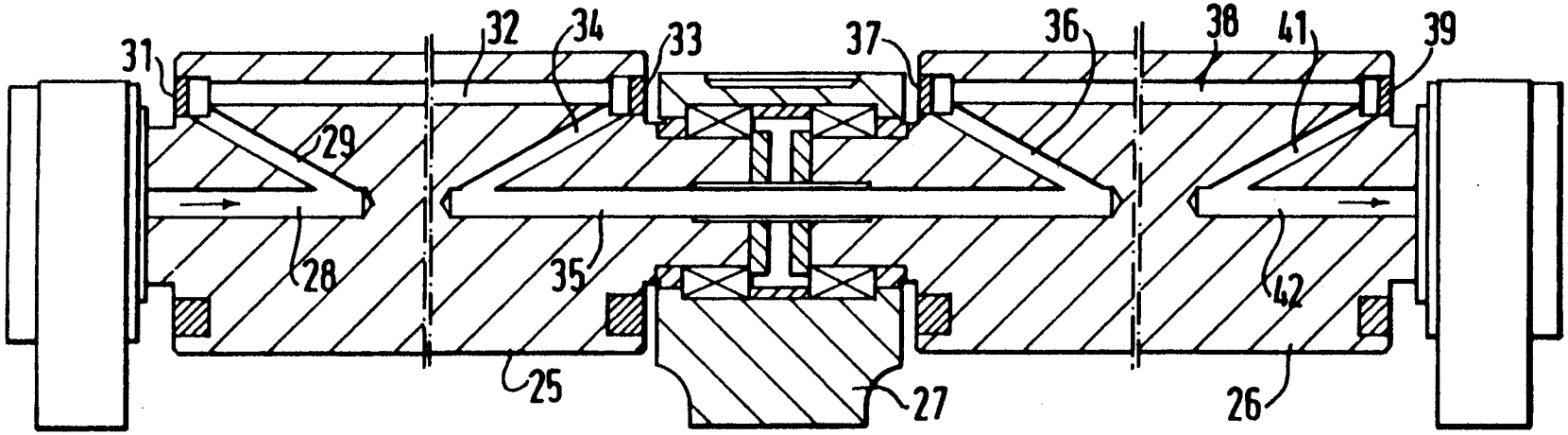
FIGS. 8 and 9 are side views in section of split rollers supported by centre bearings and manifold assemblies in accordance with the invention.

Turning now to FIG. 8 of the drawings, the roller illustrated is of a split roller design and includes a pair of rolls 25,26 supported by a central bearing assembly 27. The roller 25 includes a central passageway 28 connected to receive coolant from a source, one or more inclined bores 29 to convey this coolant to a manifold 31 of a design similar or identical to that illustrated in FIGS. 3 and 4, a plurality of peripheral bores 32 (only one of which is shown), and a manifold 33 positioned at the end of the roll remote from manifold 31. The manifolds 31,33 operate to circulate the coolant through the bores 32 in the manner discussed previously. Coolant leaving the bores 32 passes through one or more inclined bores 34 to a central passageway 35 which links the rolls 25 and 26. This central passageway communicates with one or more inclined bores 36, manifold 37, peripheral bores 38 (only one of which is shown), manifold 39, one or more inclined bores 41, and a central bore 42 through which coolant passes from the roll 26 to pass to a sink possibly for recirculation.

Figure 9:
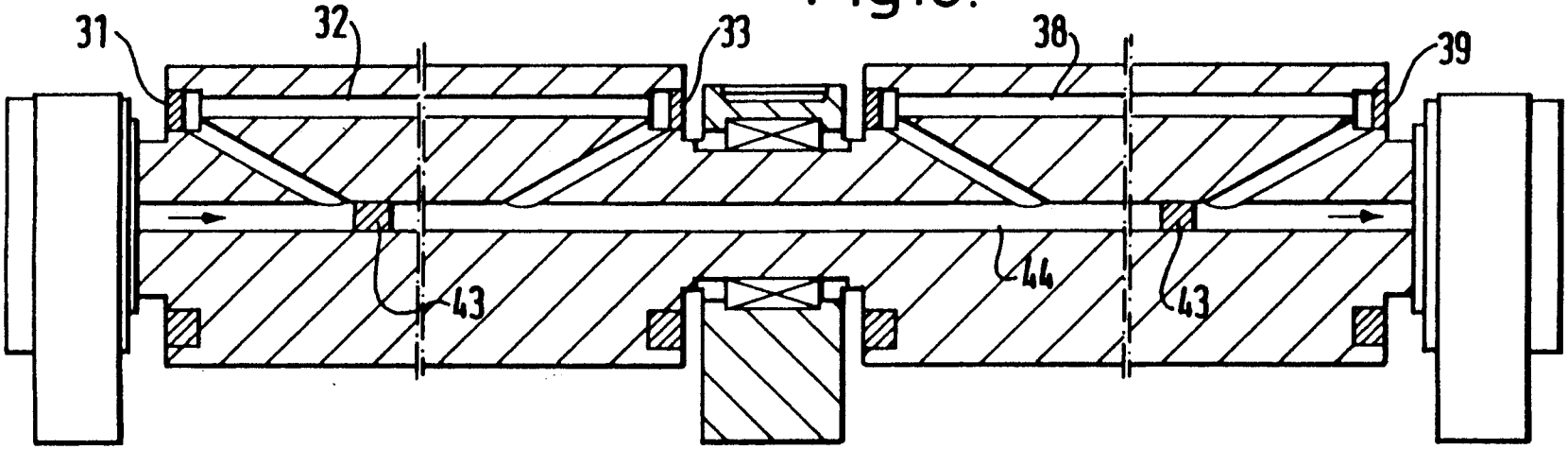

The roller illustrated in FIG. 9 is of a monoblock design and the coolant flow path is very similar to that illustrated in FIG. 8. In FIG. 9, however, stops 43 are located within a continuous central bore 44 of a conventional monoblock roller to enable the required coolant flow path to be followed.

It will be appreciated that a variety of different peripheral bore patterns and manifold designs can be employed, and that individual rollers can be used in conjunction with different manifold designs to achieve predetermined objectives. For example, neighboring bores can be arranged to convey coolant in the same or opposite flow directions; alternatively or additionally, the roller may be constructed to cause the coolant flow to circulate along each peripheral bore in sequence. It will be appreciated that such an arrangement may not provide uniform cooling around the entire roller surface. In this arrangment, therefore, it may be advantageous to split the peripheral bores 2 into two separate groups on either side of the radial axis of the roller, so that coolant flowing through one such group flows in one direction and coolant flowing through the other such group flows in the opposite direction. Many other flow patterns are possible, and by appropriate machining of the recesses of each manifold it is possible to interconnect non-adjacent peripheral to possibly define two independent circulatory systems.

It will also be appreciated that conventional rollers including central bores for the flow of coolant can readily be converted to include the features of the invention referred to above.

It is to be understood that the foregoing is merely exemplary of cooling rollers in accordance with the invention and that modifications can readily be made thereto without departing from the true scope of the invention. Thus, the end caps 6 may comprise a plurality of individual manifolds each formed with one or more recesses 7,8 and each dimensioned to embrace at least two bores 2 and/or at least one inclined bore 3.

We claim:

1. An internally cooled cylindrical roller for transporting a continuously cast strand of partially or wholly solidified metal comprising a plurality of peripheral bores formed in the roller which extend over the entire length of the roller and through which cooling liquid can circulate, an annular manifold secured within a recess formed in each end face of the roller and including a plurality of discrete pathways each positioned to place open ends of two longitudinally extending bores in communication one with another, additional pathways positioned to place an open end of one bore in communication with an inlet passageway for conveying cooling liquid to the roller, and an open end of another bore being in communication with an outlet passageway for conveying cooling fluid from the roller.

2. A roller as claimed in claim 1 wherein each discrete pathway of each manifold is positioned to place neighbouring longitudinal bores in communication one with the other.

3. A roller as claimed in claim 1 wherein the additional pathway communicates with the inlet passageway through a bore which is inclined to the longitudinal axis of the roller.

4. A roller as claimed in claim 1 wherein each manifold takes the form of an annular end cap which is secured to the respective roller end by welding.

5. A roller as claimed in claim 1 wherein each manifold locates within a step formed in the inner face of an annular flange of a journal insert of a roller.

6. A roller as claimed in claim 1 wherein each manifold includes a rearwardly extending neck section which supports a journal insert to provide a bearing shoulder therefor.

7. A roller as claimed in claim 1 wherein each manifold includes means for venting air trapped within said bores to atmosphere.

* * * * *